US010717184B2

(12) United States Patent
Frazier

(10) Patent No.: US 10,717,184 B2
(45) Date of Patent: Jul. 21, 2020

(54) BUCKET TOOL ORGANIZER

(71) Applicant: Mark Frazier, Virginia Beach, VA (US)

(72) Inventor: Mark Frazier, Virginia Beach, VA (US)

( * ) Notice: Subject to any disclaimer, the term of this patent is extended or adjusted under 35 U.S.C. 154(b) by 0 days.

(21) Appl. No.: 16/587,196

(22) Filed: Sep. 30, 2019

(65) Prior Publication Data

US 2020/0139535 A1 May 7, 2020

Related U.S. Application Data

(60) Provisional application No. 62/756,714, filed on Nov. 7, 2018.

(51) Int. Cl.
*B25H 3/00* (2006.01)

(52) U.S. Cl.
CPC ..... *B25H 3/00* (2013.01)

(58) Field of Classification Search
CPC ... B25H 3/00; B25H 3/04; B44D 3/12; B44D 3/121
USPC ..... 206/372–373; 220/735, 495.06, 495.08, 220/495.11, 908, 908.1; 248/95, 99–101
See application file for complete search history.

(56) References Cited

U.S. PATENT DOCUMENTS 1,421,628 A * 7/1922 Watkins ..... B65F 1/04 220/9.4
1,738,295 A * 12/1929 Hardy ..... A47B 95/043 220/655
3,233,644 A * 2/1966 Bono ..... D06F 95/004 220/9.1
3,893,649 A * 7/1975 Cornell ..... B65B 67/12 248/99
4,280,344 A * 7/1981 O'Connor ..... A47L 13/58 134/135
4,715,499 A * 12/1987 Franklin ..... B25H 5/00 206/373
4,715,572 A * 12/1987 Robbins, III ..... B65F 1/06 220/495.04
4,765,472 A * 8/1988 Dent ..... A47J 47/18 206/373
4,765,579 A * 8/1988 Robbins, III ..... B65F 1/06 220/495.04
4,867,332 A * 9/1989 Mains ..... B25H 3/04 220/735

(Continued)

*Primary Examiner* — Chun Hoi Cheung
*Assistant Examiner* — Brijesh V. Patel
(74) *Attorney, Agent, or Firm* — Boudwin Intellectual Property; Daniel Boudwin

(57) ABSTRACT

A bucket tool organizer includes a flexible body having a first end secured to a second end in an annular configuration. A plurality of pockets is disposed on a first side of the flexible body. A support sleeve includes a hollow cylinder having an open upper end and an open lower end. A retainer ring is configured to engage an upper edge of the support sleeve, wherein a portion of the flexible body is secured between the upper edge of the support sleeve and the retainer ring. The entire assembly is insertable into a bucket, such that the retainer ring engages an inner surface of the bucket sidewall, thereby allowing individuals to easily store tools and other items within the bucket for portability and easy access. A weatherproof lid can be secured overtop the bucket, thereby protecting the contents of the bucket.

8 Claims, 5 Drawing Sheets

(56) References Cited

U.S. PATENT DOCUMENTS 4,993,551 A * 2/1991 Lindsay ..... B25H 3/00 150/161
5,065,891 A * 11/1991 Casey ..... B65F 1/06 220/495.08
5,119,960 A * 6/1992 Robbins, III ..... B65D 1/42 220/640
5,125,183 A * 6/1992 Tisdell ..... A01K 97/06 43/54.1
5,174,447 A * 12/1992 Fleming ..... B25H 3/00 206/373
5,186,329 A * 2/1993 Fogelberg ..... B25H 3/00 206/372
5,222,704 A * 6/1993 Light ..... B65F 1/06 220/495.08
5,275,490 A * 1/1994 Loebbert ..... B65D 33/02 220/9.4
5,318,821 A * 6/1994 Bradley, Jr. ..... B65D 25/34 150/154
D350,632 S * 9/1994 Cummins ..... D32/53
5,350,065 A * 9/1994 Darrey ..... B25H 3/00 206/373
D372,125 S * 7/1996 Frazier ..... D3/315
D376,454 S * 12/1996 Fierek ..... B25H 3/00 D3/905
5,598,942 A * 2/1997 Cowie ..... B65F 1/06 220/495.01
5,803,299 A * 9/1998 Sealy, Jr. ..... B65F 1/062 220/495.07
5,924,568 A * 7/1999 Zajonc ..... B25H 3/026 206/372
6,151,910 A * 11/2000 Hazen ..... A45C 11/008 206/373
6,189,697 B1 * 2/2001 Davis ..... A45C 11/008 206/373
6,536,590 B1 3/2003 Godshaw et al.
7,131,552 B2 * 11/2006 Simonson ..... B65F 1/06 220/495.06
D806,972 S * 1/2018 Foss ..... B65D 11/22
2004/0055679 A1 * 3/2004 Gordon ..... A45C 11/24 150/112
2006/0213914 A1 * 9/2006 Victor ..... B65F 1/06 220/495.06
2007/0246959 A1 * 10/2007 Arcaro ..... A45F 5/1046 294/171
2008/0000914 A1 1/2008 Frankenstein et al.
2008/0308566 A1 * 12/2008 Fierek ..... B25H 3/00 220/735
2009/0008280 A1 * 1/2009 Nilferli ..... B25H 3/04 206/373
2009/0301912 A1 12/2009 Cornell
2012/0217247 A1 * 8/2012 Adkins ..... B65F 1/0006 220/495.08
2013/0037559 A1 2/2013 Fierek
2014/0217095 A1 8/2014 Scivoletto
2015/0034653 A1 * 2/2015 Sirko ..... B65F 1/06 220/495.08
2017/0174426 A1 * 6/2017 Bowen ..... B65F 1/06
2017/0355487 A1 * 12/2017 Guertin ..... B65D 15/08
2018/0021938 A1 * 1/2018 Sites ..... B25H 3/00 53/410
2018/0244432 A1 * 8/2018 Seiders ..... B65D 11/22

* cited by examiner

BUCKET TOOL ORGANIZER

CROSS REFERENCE TO RELATED APPLICATIONS

This application claims the benefit of U.S. Provisional Application No. 62/756,714 filed on Nov. 7, 2018. The above identified patent application is herein incorporated by reference in its entirety to provide continuity of disclosure.

BACKGROUND OF THE INVENTION

The present invention relates to organizational solutions. More specifically, the present invention provides an organizer system for a bucket that allows tools and other items to be stored within the bucket in a safe and convenient manner.

Individuals who work on construction job sites or in similar fields often have a personal supply of tools. It can be cumbersome and time consuming to store and transport tools around and between job sites. The constant moving of the tools can often lead to them becoming misplaced or possibly damaged. During inclement weather or at job sites with less than ideal working conditions, tools can become damaged to the point where they are no longer usable, and it can be wasteful and costly to purchase new tools.

While the above problems are common on many job sites, similar problems exist for individual homeowners, who must often transport their tools between various locations around their home. It is important to keep tools and similar items in an organized manner so that they are not accidentally lost and are easily accessible when needed. It is also important to store tools in a manner such that they are protected from inclement weather and other things that may cause damage. In order to address these concerns, the present invention provides a tool organizing system that can be secured within a bucket, particularly within a bucket that includes a sealing lid, such that the tools and other items are protected from the elements and efficiently organized for transport and later retrieval.

Devices have been disclosed in the known art that relate to tool organization. However, the devices in the known art have several drawbacks. The devices in the known art relate to organizers that hold tools externally to the bucket, where they may be accessed during use, but not within the bucket. Further, the devices in the known art fail to provide a bucket tool organizer with a retainer ring that seals against the interior of the bucket, such that the contents of the bucket remain secured during transportation and handling of the bucket.

In light of the devices disclosed in the known art, it is submitted that the present invention substantially diverges in design elements from the known art and consequently it is clear that there is a need in the art for an improvement to existing tool organizing devices. In this regard the present invention substantially fulfills these needs.

SUMMARY OF THE INVENTION

In view of the foregoing disadvantages inherent in the known types of tool organizer devices now present in the prior art, the present invention provides a bucket tool organizer wherein the same can be utilized for providing convenience for the user when storing an organizing tools and other items in a manner that is easy accessible and transportable. In an exemplary embodiment, the organizer system includes a flexible body having a first end secured to a second end in an annular configuration, wherein a plurality of pockets is disposed on a first side of the flexible body. A support sleeve includes a hollow cylinder having an open upper end and an open lower end, wherein the support sleeve is positioned within a similarly sized bucket. A retainer ring is configured to engage an upper edge of the support sleeve, such that a portion of the flexible body is secured between the upper edge of the support sleeve and the retainer ring. The organizer system allows tools and other items to be secured within the bucket such that they are protected from the elements yet easily accessible when needed.

One object of the present invention is to provide a bucket tool organizer that has all of the advantages of devices in the known art and none of the disadvantages.

Another object of the present invention is to provide a bucket tool organizer that secures entirely within the interior of a lidded bucket, such that the contents of the organizer are protected within a weatherproof enclosure.

A further object of the present invention is to provide a bucket tool organizer having components that can be easily disconnected from one another, namely the retainer ring, flexible body, and support sleeve, such that they can be compactly stored when not in use.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
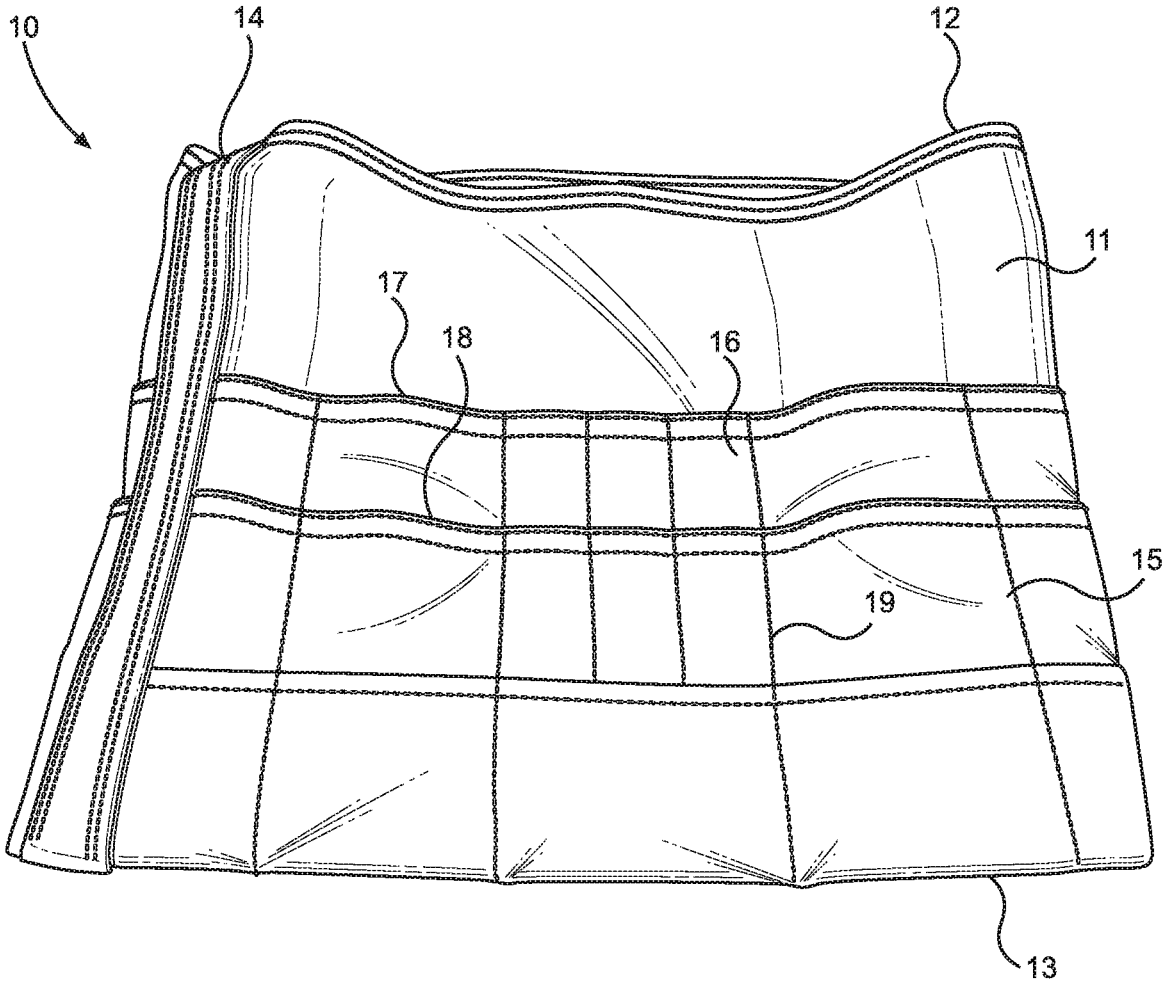
FIG. 1 shows a perspective view of the flexible body of an embodiment of the bucket tool organizer system.

Reference is made herein to the attached drawings. Like reference numerals are used throughout the drawings to depict like or similar elements of the bucket tool organizer. For the purposes of presenting a brief and clear description of the present invention, the preferred embodiment will be discussed as used for securing an organizer for tools and other items within a bucket, such that they are portable and easy to access when needed. The figures are intended for representative purposes only and should not be considered to be limiting in any respect.

Referring now to FIG. 1, there is shown a perspective view of the flexible body of an embodiment of the bucket tool organizer. The bucket tool organizer system includes an organizer 10 having a flexible body 11 that is composed of a durable fabric or any other suitable material. The flexible body 11 maintains an annular configuration, defining an open upper end 12 and an open lower end 13. In the illustrated embodiment, the flexible body 11 is a continuous loop formed by stitching together opposing ends of the flexible body 11. In some embodiments, the flexible body 11 includes disconnected ends that are secured together via a fastener 14 to maintain the annular configuration. The fastener 14 may include hook and loop material, snaps, or any other suitable type of fastener.

The flexible body 11 includes a plurality of main pockets 15 disposed on one side thereof. In the shown embodiment, the organizer 10 further includes smaller secondary pockets 16. Each individual secondary pocket 16 has a width that is less than a width of each main pocket 15, such that different tools and other items can be placed within suitably sized pockets. Other embodiments may include additional pocket configurations for holding particular types of tools or other particular items.

Each pocket 15, 16 includes an open upper end 17 and a closed lower end 18, such that items can be secured within the pockets 15, 16 and yet still be easily accessed when needed. The individual pockets 15, 16 are separated via stitching 19 that extends through the material of the flexible body 11. The non-rigid nature of the flexible body 11 allows the organizer 10 to move between a position where the pockets 15, 16 are on the exterior, as shown in FIG. 1, to allow the structure of the pockets to be seen. However, in use, the flexible body 11 of the organizer 10 is inverted, such that the pockets 15, 16 are positioned on an interior side of the flexible body 11.

Figure 2:
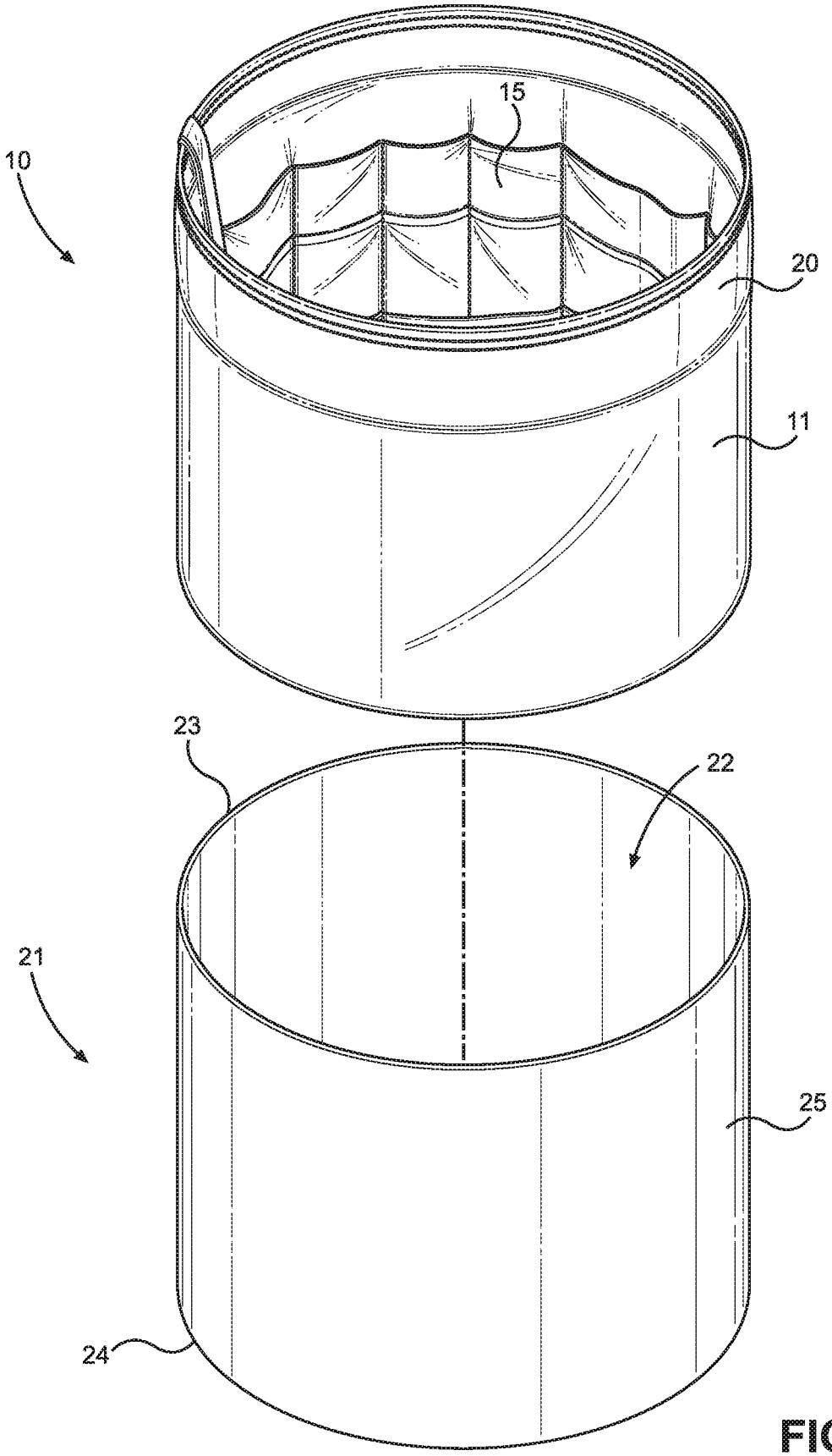
FIG. 2 shows an expanded perspective view of the support sleeve and flexible body of an embodiment of the bucket tool organizer.

Referring now to FIG. 2, there is shown an expanded perspective view of the support sleeve and flexible body of an embodiment of the bucket tool organizer. The organizer 10 is insertable into a support sleeve 21. The support sleeve 21 includes a hollow cylinder 25 having an upper edge 23 and a lower edge 24, defining an interior channel 22 that is sized to receive the flexible body 11 of the organizer. In operation, the flexible body 11 is oriented such that the pockets 15 are interior facing. The flexible body 11 is then inserted into the interior channel 22 of the support sleeve 21. An upper portion 20 of the flexible body 11 extends upwardly past the upper edge 23 of the support sleeve, such that the upper portion 20 can be folded down over the upper edge 23 and around the hollow cylinder 25 of the support sleeve 21.

Figure 3:
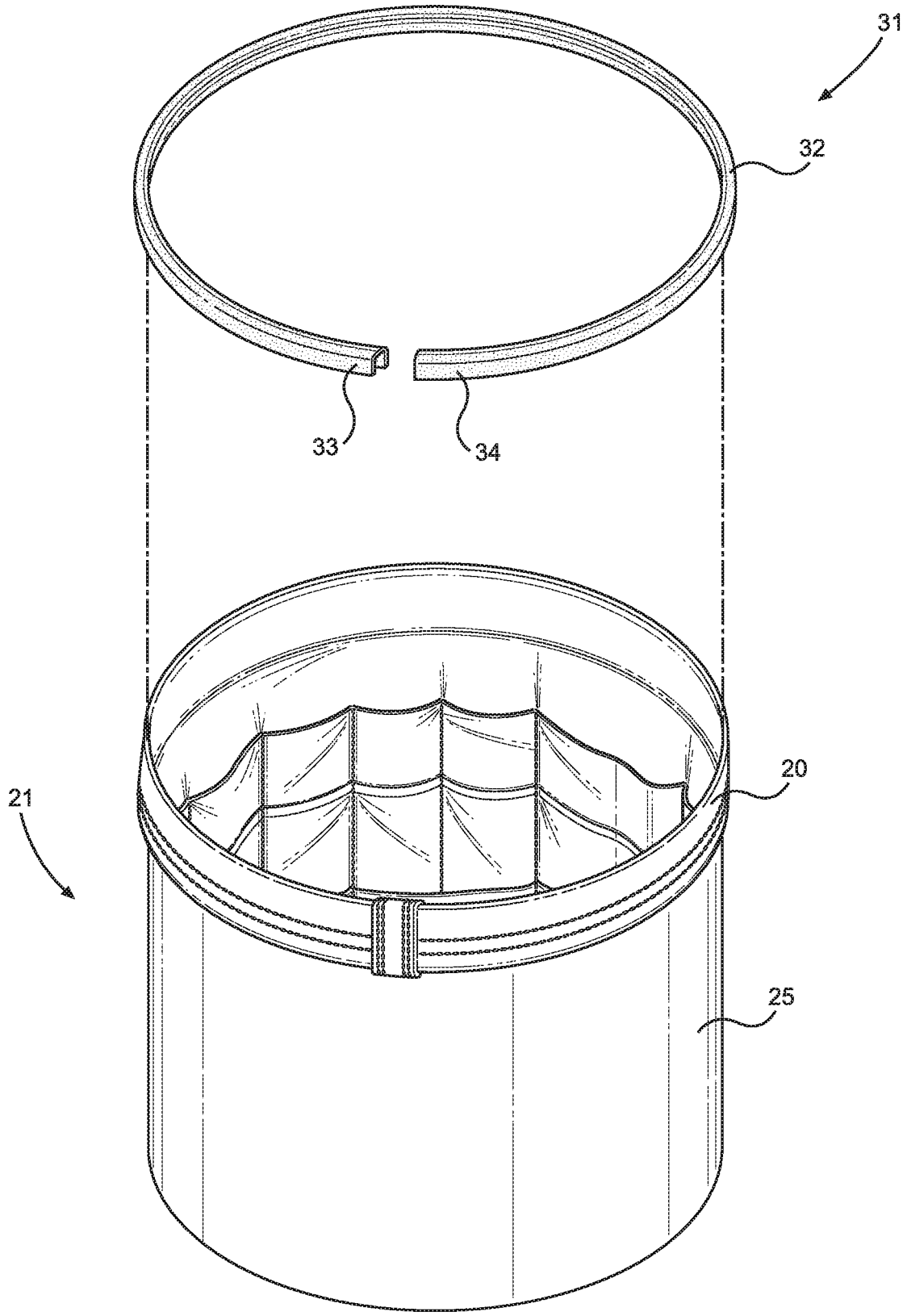
FIG. 3 shows an expanded perspective view of the retainer ring, support sleeve, and flexible body of an embodiment of the bucket tool organizer.

Referring now to FIG. 3, there is shown an expanded perspective view of the retainer ring, support sleeve, and flexible body of an embodiment of the bucket tool organizer. The upper portion 20 of the flexible body is folded over the upper edge of the cylinder 25 of the support sleeve 21, loosely securing the flexible body to the support sleeve 21. To facilitate the connection between the support sleeve 21 and the flexible body of the organizer, the upper portion 20 includes no pockets thereon, providing a more uniform attachment surface.

A retainer ring 31 includes a flexible member 32 which can maintain a circular shape corresponding to the cross-sectional shape of the support sleeve 21. The flexible member 32 is composed of rubber or any other suitable durable, flexible, and weatherproof material. In the shown embodiment, the flexible member 32 is disconnected and includes opposing ends 33, 34, such that the flexible member 32 can be easily manipulated to install or uninstall the retainer ring 31. The retainer ring 31 includes a pair of parallel walls defining a U-shaped channel which receives and engages the upper edge of the support sleeve 21. In this way, the upper portion 20 portion of the flexible body is secured between the upper edge of the support sleeve 21 and the retainer ring 32, as shown in FIG. 4.

Figure 4:
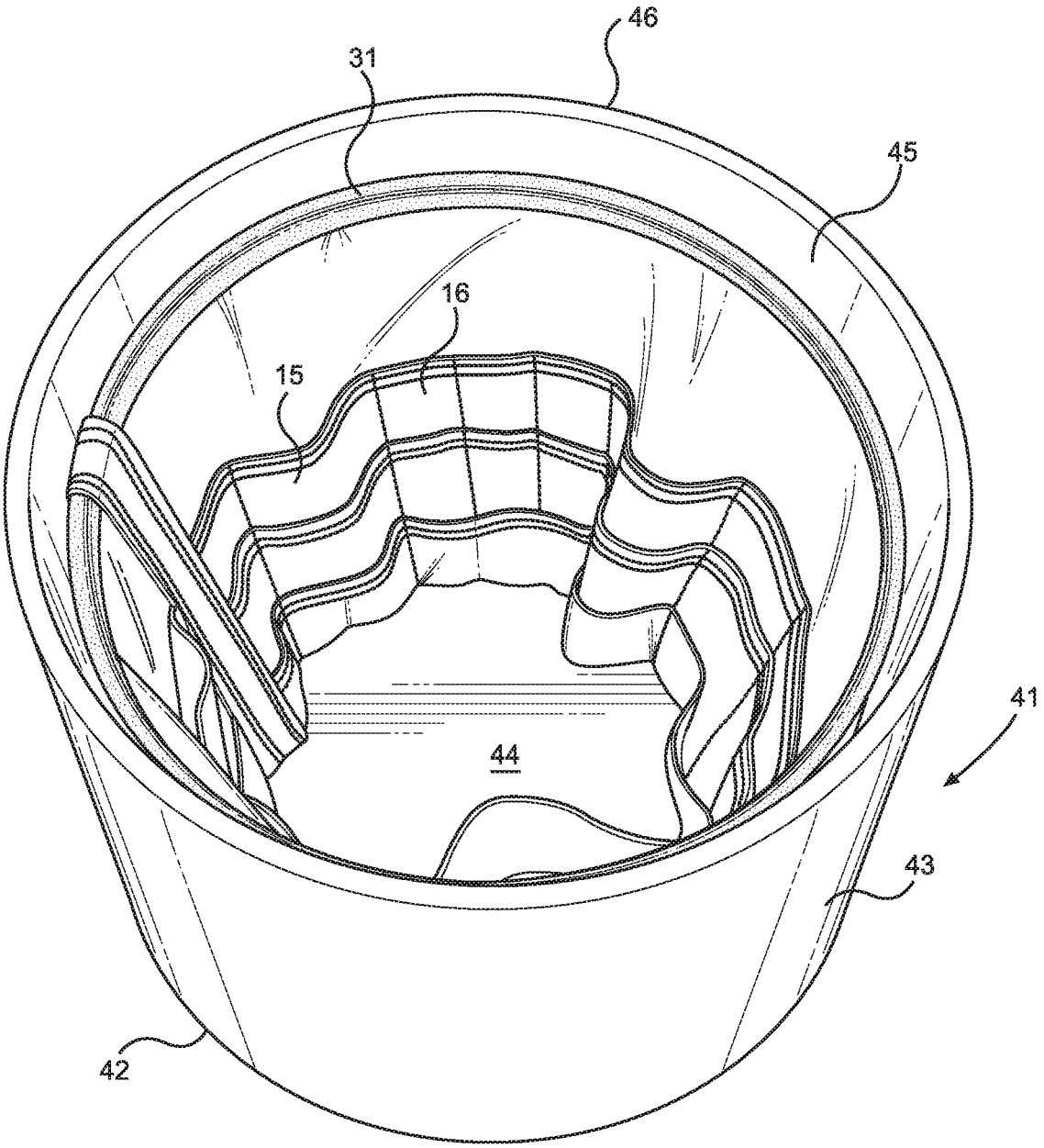
FIG. 4 shows a perspective view of an embodiment of the bucket tool organizer in use.
Figure 5:
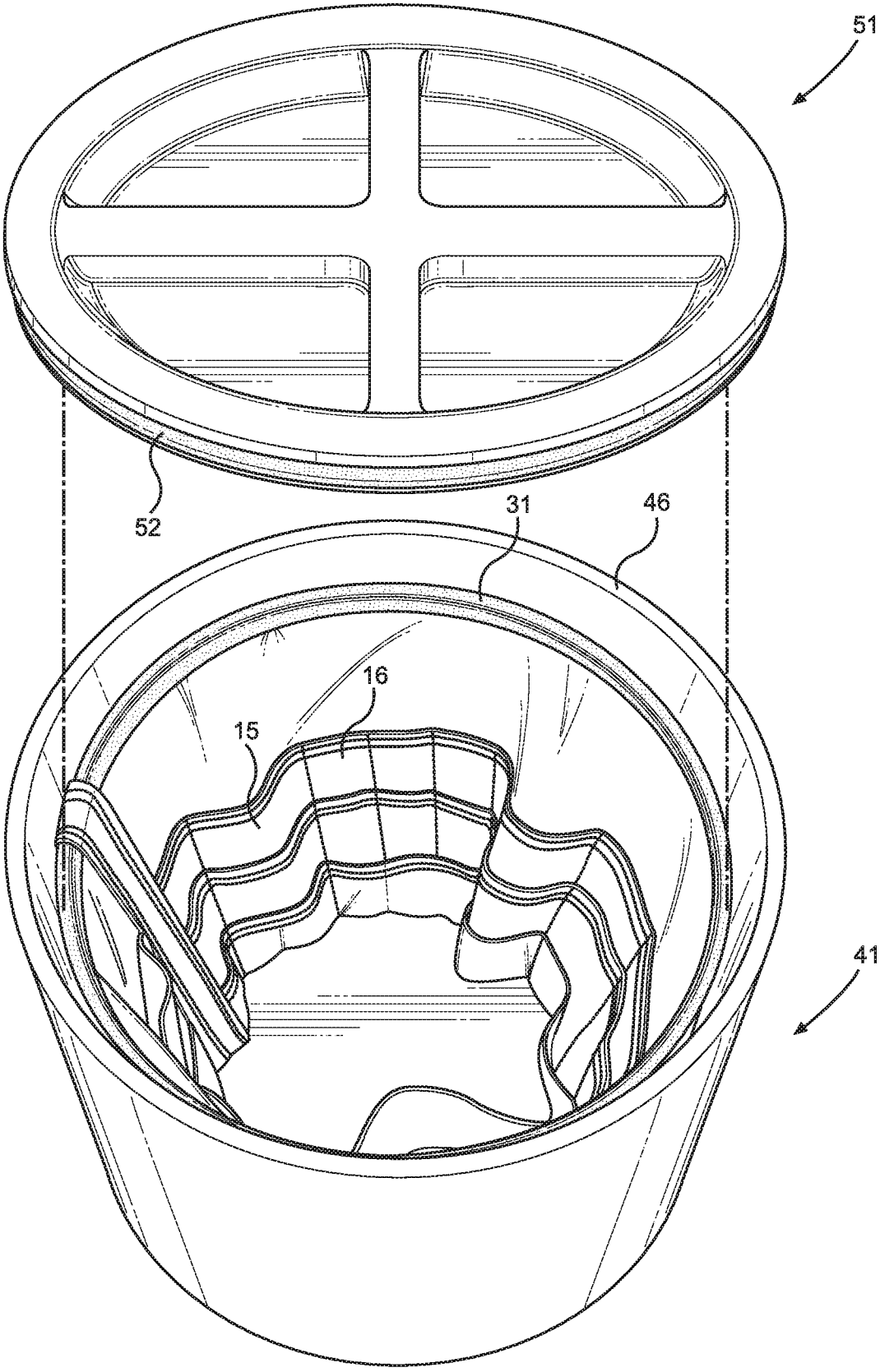
FIG. 5 shows an alternate perspective view of an embodiment of the bucket tool organizer in use.

Referring now to FIGS. 4 and 5, there are shown multiple perspective views of an embodiment of the bucket tool organizer in use. In operation, the organizer system is supported within a bucket 41. The bucket includes a base 42, a perimeter sidewall 43, and an open upper end 46 defining an interior volume. The interior volume is sized to receive the assembled support sleeve, flexible body, and retainer ring 31, such that support sleeve rests on the floor 44 of the bucket 41. When the support sleeve is supported within the bucket 41, the retainer ring 31 makes flush contact with an interior side 45 of the perimeter sidewall 43 of the bucket 41, forming a seal therebetween. The seal helps effectively secure the organizer system within the bucket 41 during movement of the bucket 41.

As shown in FIG. 5, the bucket 41 may also include a lid 51 configured to be removably secured over the open upper end 46 of the bucket 41. The lid 51 can be removably secured to the bucket 41 via a threaded connection, friction fit, or any other effective securement mechanism. In the shown embodiment, the lid 51 includes a gasket 52 on a lower side thereof. The gasket 52 is configured to form a weatherproof seal when secured over the open upper end 46 of the bucket 41. In this way, a watertight and weatherproof enclosure is formed, thereby protecting the contents of the pockets 15, 16 from inclement weather, moisture, and other hazards.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tool organizer system, comprising:

a flexible body comprising an annular configuration having an open upper end and an open lower end;

a plurality of pockets disposed on a first side of the flexible body;

a support sleeve comprising an annular body having an open upper end and an open lower end;

a retainer ring configured to engage an upper edge of the support sleeve, wherein a portion of the flexible body is secured between the upper edge of the support sleeve and the retainer ring;

a bucket comprising a base, a perimeter sidewall extending upwardly therefrom, and an open upper end defining an interior volume, wherein the interior volume is sized to receive the support sleeve therein, such that the retainer ring maintains a seal against an inner wall of the bucket.

2. The tool organizer system of claim 1, further comprising a lid configured to removably secure over the open upper end of the bucket, wherein the lid comprises a gasket configured to maintain a weatherproof seal when the lid is secured to the bucket.

3. The tool organizer system of claim 1, wherein the plurality of pockets comprises a first pocket having a first width and a second pocket having a second width that is narrower than the first width.

4. The tool organizer system of claim 1, wherein a first end of the flexible body is removably secured to a second end of the flexible body via a fastener.

5. The tool organizer system of claim 1, wherein the retainer ring comprises a pair of parallel walls defining a U-shaped channel.

6. The tool organizer system of claim 1, wherein the retainer ring is composed of a flexible rubber material.

7. The tool organizer system of claim 1, wherein the retainer ring includes a first end disconnected from a second end.

8. The tool organizer system of claim 1, wherein the portion of the flexible body that is secured between the upper edge of the support sleeve and the retainer ring comprises a continuous surface that is free of any pockets.

* * * * *